United States Patent [19]

Eberl, deceased et al.

[11] Patent Number: 4,747,760

[45] Date of Patent: May 31, 1988

[54] HAND-ACTUATABLE PUMP FOR FEED PUMPS OF FUEL INJECTION SYSTEMS FOR INTERNAL COMBUSTION ENGINES

[75] Inventors: Leonhard Eberl, deceased, late of Unterschleissheim, Fed. Rep. of Germany, by Anna Eberl, Robert L. F. Eberl, heirs; Karl Mielich, Baldham, Fed. Rep. of Germany; Miklos Mozes, Munich, Fed. Rep. of Germany; Walter Schmid, Munich, Fed. Rep. of Germany; Klaus Stieninger, Munich, Fed. Rep. of Germany

[73] Assignee: Robert Bosch GmbH, Stuttgart, Fed. Rep. of Germany

[21] Appl. No.: 893,140

[22] Filed: Aug. 5, 1986

[30] Foreign Application Priority Data

Sep. 27, 1985 [DE] Fed. Rep. of Germany ..... 3534485

[51] Int. Cl.[4] ..... F04B 21/02

[52] U.S. Cl. ..... 417/443; 123/187.5 R; 417/520

[58] Field of Search ..... 417/328, 437, 443, 471, 417/520, 569; 123/447, 495, 180 P, 198 C, 187.5 R

[56] References Cited

U.S. PATENT DOCUMENTS

| | | | |
|---|---|---|---|
| 2,966,861 | 1/1961 | Stewart et al. | 417/569 |
| 3,288,072 | 11/1966 | McKenzie | 417/520 |
| 3,500,759 | 3/1970 | Potter et al. | 417/534 |
| 3,669,576 | 6/1972 | Little et al. | 417/571 |
| 3,803,968 | 4/1974 | Orr | 92/85 |
| 4,012,174 | 3/1977 | Seibel et al. | 417/437 |

*Primary Examiner*—Leonard E. Smith
*Attorney, Agent, or Firm*—Edwin E. Greigg

[57] ABSTRACT

A pump for feed-pumps of fuel injection systems for internal combustion engines having a manually actuatable element, which operates counter to the force of a restoring spring to effect an inward stroke of a piston which includes a valve tappet thereon that pushes open a ball valve to the fuel feeding system of a feed pump. In operation, a medium is positively displaced from a work chamber into the feeding system. Upon an automatic return stroke of the piston, a medium is aspirated from the fuel feeding system of the feed pump into the work cylinder and at the end of the return stroke the ball valve closes automatically. In its position of repose, the pump does not require its piston to be locked in place, and pressure impacts of the feed pump are prevented from reaching the piston.

14 Claims, 1 Drawing Sheet

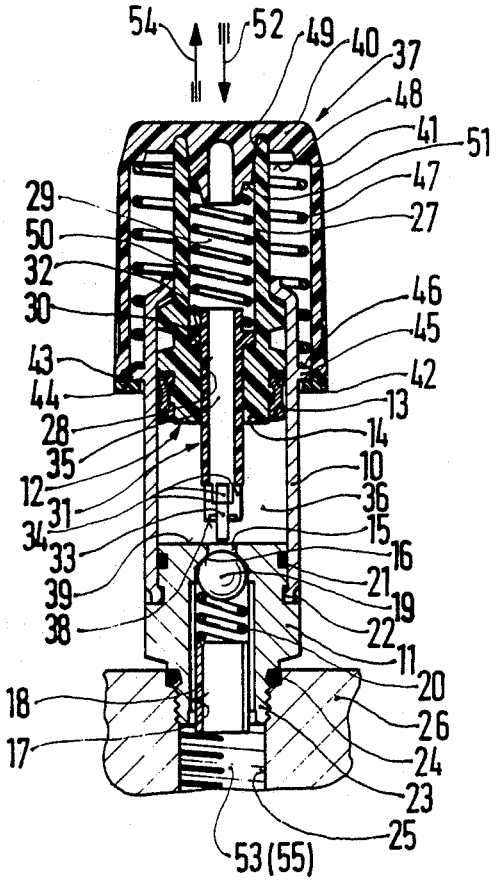
54
52
49
40
37
48
41
51
47
27
29
50
32
30
46
45
43
42
44
13
28
14
35
10
12
36
31
15
34
16
33
21
39
19
38
22
11
20
18
26
17
24
23
25
53 (55)

HAND-ACTUATABLE PUMP FOR FEED PUMPS OF FUEL INJECTION SYSTEMS FOR INTERNAL COMBUSTION ENGINES

BACKGROUND OF THE INVENTION

The invention relates to a hand-actuatable pump for feed pumps of fuel injection systems for internal combustion engines. Manually actuatable pumps of this kind serve to fill the system when it is put into operation, or for refilling and venting after some intervention has been made, such as changing a filter insert or filter box. In the position of repose of the pump, the piston has to be locked in the cylinder, to prevent pressure impacts (pressure peaks) of the feed pump from damaging or even destroying the piston or the seals, which would render the pump inoperable.

U.S. Pat. No. 3,803,988 discloses a pump of this kind, in which the locking is effected by means of a bayonet lock for locking the actuating element to the cylinder. Another type of pump is described having a piston with a threaded protrusion and a cylinder having a corresponding internal thread. Locking is effected here by screwing the threaded protrusion into the internal thread.

In practice, however, it has been found that the locking did not always take place, which caused the above-mentioned damage to the pump, or even its failure.

OBJECT AND SUMMARY OF THE INVENTION

With the invention, the above-discussed problem is solved by technologically simple means, and after actuaton of the pump it is no longer necessary to lock or otherwise fix the piston to the cylinder. By means of the static sealing in the end position of the piston, the idle volume is reduced to a minimum, on the one hand, and pressure peaks are prevented at the dynamic piston seal. Because the pump requires only pressure actuation, it is still actuatable even at poorly accessible locations.

Advantageous further embodiments of the invention are described hereinafter in which differences in stroke between the valve and the piston are balanced out in an advantageous manner. On the one hand the interior of the pump is protected from dirt and splashing water, and on the other hand a defined stop for the piston in its outer dead center position is provided.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing, in an axial section and in full scale, shows a hand-actuatable pump for feed pumps of fuel injection systems for internal combustion engines.

DESCRIPTION OF THE PREFERRED EMBODIMENT

A hand-actuatable manual pump for feed pumps of fuel injection systems of internal combustion engines has a cylinder 10 having a bottom part at its end embodied as a screw-mounted connector pipe 11 and a piston 12 having an end protrusion 14, with a double lip seal 13 cooperating with the cylinder 10 snapped onto the end protrusion 14. The screw-mounted connector pipe 11 has a bore 15, which widens into a conical valve seat 16 that merges with a second bore 17 having a support sleeve 18 pressed into it. A valve ball 19, as a blocking part of a blocking element, is pressed against the valve seat 16 by a valve spring 20 that rests on the support sleeve 18. The valve seat 16 and the valve ball 19 together form the blocking element, in the form of a ball valve 16/19.

Sealing and securing of the cylinder 10 on the screw-mounted connector pipe 11 are effected by an O-ring 21 or by a plurality of mortised locations 22. The screw-mounted connector pipe 11 has a threaded protrusion 23, which is screwed, with an interposed sealing ring 24, into an internal thread 25 of a conduit leading to the work chamber of a feed pump 26.

The piston 12 has an axial bore 28 and on its end has a hollow cylindrical piston rod 27, the hollow chamber 29 of which, together with the bore 28, forms an annular inner shoulder 30. A hollow-cylindrical valve tappet 31 has at one end an outer collar 32 resting on the inner shoulder 30 and on its other end a plurality of radial slits 34 and a central protrusion 33. One end face of the valve tappet 31 forms a stop 38, which cooperates with the end face 39 of the screw-mounted connector pipe 11 in a manner to be described below. The work chamber of the manual pump is formed by the hollow chamber 29 of the piston rod 27, a hollow chamber 35 of the valve tappet 31 and a hollow chamber 36, which is defined by the cylinder 10, the screw-mounted connector pipe 11 and the piston 12.

An actuating element 37 made of plastic has an end plate 40, the outer edge of which is extended in the form of a sleeve 41 having an inner groove 42 on its end, the groove being engaged by a bead 43 of a stop ring 44, which is secured to the sleeve 41 by ultrasonic welding. An outer ring 45 stands off from the jacket of the cylinder 10, one one shoulder of which the stop ring 44 is supported and on the opposite shoulder 46 of which a restoring spring for the piston 12, embodied as a helical compression spring 47, is supported; on the other end, the helical compression spring 47 presses against an annular shoulder 48 of the actuating element 37. The stop ring 44 and at least the piston rod 27 are made of fuel-resistant plastic.

The piston rod 27 is secured in an annular groove 49 of the actuating element 37 by ultrasonic welding. A pre-stressed retaining spring 50 is embodied as a helical compression spring, which is supported on a second annular shoulder 51 of the actuating element 37 and keeps the outer collar 32 of the valve tappet 31 pressed against the inner shoulder 30 of the piston 12.

The hand-operated pump functions as follows:

In the position of repose shown, the ball valve 16/19 is closed, and the work chamber of the pump defined by the hollow chambers 29 and 35 as well as 36 is filled with air or some medium, such as fuel or a mixture of fuel and air. A pressure in the direction of the arrow 52 upon the actuating element 37 effects the inward stroke of the piston 12, counter to the force of the restoring spring 47, whereupon the protrusion 33 pushes the ball valve 16/19 open and as a result, the medium is positively displaced out of the work chamber 29/35/36 into the pressure system 53 of the feed pump 26. The continuing inward stroke, by cooperation of the stop 38 with the end face 39, effects the stoppage of motion of the valve tappet 31, so that subsequently the pressure force 52—supplementing the force of the restoring spring 47—counteracts the force of the retaining spring 50. During the entire inward stroke, air or the medium, that is, fuel or a fuel-air mixture, is positively displaced out of the work chamber 29/35/36 into the pressure system 53 of the feed pump 26. The pressure system 53 and an intake system 55 form the feeding system of the feed pump 26, well-known and not further shown and described.

After the inward stroke and after the cessation of the pressure force expressed by the arrow 52, the return stroke of the piston 12 takes place automatically in reverse succession, until the position of repose, shown, of the pump is attained, in which the ball valve 16/19 is closed; in this process, air or the medium, that is, fuel or a fuel-air mixture, is aspirated from the intake system 55 of the feed pump 26 into the work chamber 29/35/36. By the alternating aspiration of the medium out of the intake system 55 and its compression into the pressure system 53, the feeding system is filled and simultaneously vented.

The hand-operated pump is also usable to the same end in pipelines and the like, in which case the manual pump is then mounted on a separate housing that has a suction valve—which is required for its function—and a pressure valve. As a rule, as when the pump is mounted on the feed pump as shown, the hand pump makes shared use of the suction and pressure valve of the feed pump, not shown.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United Stated is:

1. A hand-actuatable pump for feed pumps of fuel injection systems for internal combustion engines, comprising a housing, a cylinder fixed on said housing of the feed pump, a piston rod, a piston displaceable by said piston rod and an actuating element, said piston having one end fixedly secured in an annular groove (49) of said actuating element (37), said piston and cylinder forming a work chamber, wherein upon a working stroke of said piston departing from its position of repose, a fluid medium (fuel or a fuel-air mixture) is positively displaced from said work chamber into a fuel feeding system of the feed pump and upon a return stroke of said piston said fluid medium is aspirated out of said fuel feeding system of said feed pump into said work chamber, a restoring spring (47) for the piston (12) disposed between said actuating element (37) and said cylinder (10), and a blocking element including a blocking part (19) and a valve seat (16) between said work chamber (29/35/36) and said fuel feed system (53, 55) of said feed pump (26), said blocking part (19) is pushed open at least indirectly by said piston (12), during substantially a whole movement said working stroke (arrow 52) closes automatically shortly before the piston (12) reaches the end of the return stroke (arrow 54).

2. A hand-actuatable pump for feed pumps of fuel injection systems for internal combustion engines, comprising a housing, a cylinder fixed on said housing of the feed pump, a piston rod, a piston displaceable by said piston rod and an actuating element, said piston and cylinder forming a work chamber, wherein upon a working stroke of said piston departing from its position of repose, a fluid medium (fuel or a fuel-air mixture) is positively displaced from said work chamber into a fuel feeding system of the feed pump and upon a return stroke of said piston said fluid medium is aspirated out of said fuel feeding system of said feed pump into said work chamber, a restoring spring (47) for the piston (12) disposed between said actuating element (37) and said cylinder (10), and a blocking element including a block part (19) and a valve seat (16) between said work chamber (36) and said fuel feed system (53, 55) of said feed pump (26), said blocking part (19) may be pushed open by said piston (12) via a spring-loaded yieldable means during substantially a whole movement said working stroke (arrow 52) closes automatically shortly before the piston (12) reaches the end of the return stroke (arrow 54), said spring-loaded yieldable means is formed by a valve tappet (31) which is elastically connected to said piston (12) and rests on a shoulder (30) in a hollow chamber 29 of said piston (12) remote from said work chamber (36), a retaining spring (50) supported on said actuating element (37) which presses said valve tappet (31) against the shoulder (30) of the piston (12).

3. A pump as defined by claim 2, in which said piston rod (27) is fixedly secured in an annular groove (49) of said actuating element (37).

4. A pump as defined by claim 2, in which said valve tappet (31) is tubular in form and includes a protrusion (33), which raises said blocking part (19) of said blocking element from the valve seat (16), and a stop (38) which limits the stroke of the valve tappet (31).

5. A pump as defined by claim 4, in which said piston rod (27) is fixedly secured in an annular groove (49) of said actuating element (37).

6. A pump as defined by claim 2 in which said cylinder includes a bottom part on one end thereof, and said blocking element (16/19) is disposed in the bottom part (11) of the cylinder (10) and is embodied as a spring-loaded valve.

7. A pump as defined by claim 6, in which said valve tapped (31) is tubular in form and includes a protrusion (33), which raises said blocking part (19) of said blocking element from the valve seat (16), and a stop (38) which limits the stroke of the valve tappet (31).

8. A pump as defined by claim 6, in which said bottom part (11) is embodied as a screw-mounted connector pipe, having a threaded protrusion (23) that is screwed into an internal thread (25) of said feed pump (26).

9. A pump as defined by claim 6, which includes a piston seal, said piston seal is a double lip seal (13), which is secured on an end protrusion (14) of said piston (12).

10. A pump as defined by claim 2, in which said piston (12) and said piston rod (27) are tubular in shape, and both include a hollow chamber, said hollow chamber (29) of the piston rod (27) receives said retaining spring (50), and said restoring spring (47) of said piston (12) is embodied as a helical compression spring and supported between an annular shoulder (48) of the actuating element (37) and an outer shoulder (46) of the cylinder (10).

11. A pump as defined by claim 10, in which an outer ring (45) of said cylinder (10) forms said outer shoulder (46) for said restoring spring (47) and that said actuating element (37) includes a plate (40) on an outer edge of which a sleeve (41) is formed.

12. A pump as defined by claim 11, which includes a stop ring (44), said stop ring is secured on an end face of said sleeve (41) of said actuating element (37), which stop ring, in the position of repose of the pump, rests on said outer ring (45) of the cylinder (10) by means of the force of said restoring spring (47).

13. A pump as defined by claim 12, in which said stop ring (44) has a bead (43), which engages an inner groove (42) of said end face of said sleeve (41) of said actuating element (37).

14. A pump as defined by claim 12, in which said piston rod (27), said actuating element (37) and said stop ring (44) are made of plastic.

* * * * *

UNITED STATES PATENT AND TRADEMARK OFFICE

CERTIFICATE OF CORRECTION

PATENT NO. : 4,747,760

DATED : May 31, 1988

INVENTOR(S) : LEONHARD EBERL (Deceased) et al

It is certified that error appears in the above—identified patent and that said Letters Patent is hereby corrected as shown below:

Col. 4, Claim 2, line 11, after "52)", insert --and--.

Col. 3, Claim 1, line 55, after "(12)", delete the comma; and line 56, after "movement", insert --of--, line 57, after "52)", insert --and--.

Signed and Sealed this

Eighteenth Day of October, 1988

*Attest:*

DONALD J. QUIGG

*Attesting Officer*

*Commissioner of Patents and Trademarks*